US006163103A

United States Patent [19]

Tomihari

[11] Patent Number: 6,163,103

[45] Date of Patent: Dec. 19, 2000

[54] FIELD EMISSION TYPE COLD CATHODE AND ELECTRON TUBE

[75] Inventor: Yoshinori Tomihari, Tokyo, Japan

[73] Assignee: NEC Corporation, Tokyo, Japan

[21] Appl. No.: 09/111,870

[22] Filed: Jul. 8, 1998

[30] Foreign Application Priority Data

Aug. 11, 1997 [JP] Japan ..... 9-216406

[51] Int. Cl.[7] ..... H01J 33/00

[52] U.S. Cl. ..... 313/309; 313/336; 313/351; 313/495

[58] Field of Search ..... 313/309, 336, 313/351, 495, 497

[56] References Cited

U.S. PATENT DOCUMENTS 4,940,916 7/1990 Borel et al. ..... 313/306
6,031,322 2/2000 Takemura et al. ..... 313/309

OTHER PUBLICATIONS

C.A. Spindt, "A Thin–Film Field–Emission Cathode", *J. Applied Physics*, vol. 39, No. 7, Jun. 1968, pp. 3504–3505.

*Primary Examiner*—Ashok Patel
*Attorney, Agent, or Firm*—Sughrue, Mion, Zinn, Macpeak & Seas, PLLC

[57] ABSTRACT

A field emission cold cathode sends forth uniform emission over the entire emission area and realizes, when applied to a flat screen display device and the like, a uniform brightness of images over the entire display area, providing a high quality field emission type cold cathode. An electron tube is equipped with the cold cathode. The cold cathodes structurally prevent a prolonged electric discharge with the use of trenches. Non-uniformity of resistance, resulting from the difference in extension of the depletion regions in each block divided by the trenches, can be prevented by an arrangement of blocks in which each block divided by trenches is placed to have a prescribed distance from an adjacent block, which makes emission currents in all blocks within the formed emitter area uniform at the time of normal operation, and thereby a good form in which depressions in the block corner sections are well suppressed can be obtained.

6 Claims, 5 Drawing Sheets

FIELD EMISSION TYPE COLD CATHODE AND ELECTRON TUBE

BACKGROUND OF THE INVENTION

1. Field of the Invention

The present invention relates to a cold cathode which can serve as an electron emission source and more particularly to a field emission type cold cathode which emits electrons from pointed apexes thereof and an electron tube equipped with the said cold cathode.

2. Description of the Prior Art

A structure of a cold cathode element, field emitter arrays (abbreviated FEAs hereinafter), was already described in Journal of Applied Physics, Vol.39, No.7, p.3504, 1968, wherein minute cold cathodes are arranged in arrays, each cold cathode comprising an emitter in the form of a miniature cone and a gate electrode which is formed very close to the emitter and has a current control function and a function to draw out currents from the emitter.

FEAs (cold cathode element) in such a structure are called Spindt-type cold cathodes after the developer thereof and have merits such as a capability to attain a high current density, compared with thermionic cathodes, and a narrow velocity distribution of emitted electrons therefrom.

Further, FEAs produce less current noise, in comparison with single field emitters utilized in conventional electron microscopes, and are characterized by operating with low voltages ranging from several tens to 200 V.

Further, while the single field emitters utilized in electron microscopes require a vacuum with an ultra-high degree of the order of $10^{-8}$ Pa, FEAs are characterized by a capability to operate even in a sealed glass tube in a vacuum environment of $10^{-4}$~$10^{-6}$ Pa, owing to the structure in which gate electrodes are placed very close to emitters and to having a plurality of emitters therein.

FIG. 5 shows a cross-sectional view of the main part structure of the conventional Spindt-type FEAs (cold cathode element). On a silicon substrate 101, a plurality of emitters 102 in the form of a miniature cone with a height of approximately 1 $\mu$m are formed by the vacuum vapor deposition method and around each emitter 102, a gate electrode 103 and an insulating layer 104 are formed.

The substrate 101 and the emitter 102 are electrically connected and, as a sandwich voltage for the substrate 101, the emitter 102 and the gate electrode 103, a DC voltage of approximately 100 V is applied to the gate electrode 103, being positively polarized with respect to the substrate and the emitter. The distance between the substrate 101 and the gate electrode 103 is approximately 1 $\mu$m and a diameter of the opening in the gate electrode is also as narrow as 1 $\mu$m, and, moreover, the apex of the emitter 102 is formed to be sharply pointed so that a strong electric field is applied to the apex of the emitter 102.

When the intensity of this electric field becomes equal to or more than 2~5×$10^7$ V/cm, electrons are sent forth from the apex of the emitter 102 and an electric current of 0.1~several tens of $\mu$A per emitter is obtained. By arranging in arrays a plurality of minute cold cathodes with such a structure, a plane-shaped cathode from which a high electric current can flow out is constituted.

As for the application of such Spindt-type cold cathodes, the flat screen display device, the electron tubes such as the camera tube, the microwave tube and the Braun tube and the electron sources for various sensors have been proposed.

In general, FEAs (cold cathode element) have a structure wherein, by narrowing the gap between the emitter and the gate electrode up to $\mu$m~sub $\mu$m, and further, by making the apex of the emitters sharply pointed, a strong electric field is applied to the apex of the emitter. Consequently, when the degree of vacuum in operation is lowered, electric discharge is liable to occur between the emitter and the gate electrode.

A prolonged electric discharge melts the emitter and then leads to a breakdown through melting even the surrounding gate electrode and insulating layer, resulting in a short-circuit between the emitter and the gate electrode.

In order to prevent such breakdown by short-circuits between the emitters and gate electrodes due to a prolonged electric discharge, a method to form a resistive layer right under the emitters on the substrate and make the conductive pattern for supplying power to the emitters as a meshed form is disclosed in U.S. Pat. No. 4,940,916. However, this method requires to make the conductive pattern as a meshed form so that the density of elementary emitters cannot be increased.

Further, because an emitter located in the central region of this mesh has a higher resistance than an emitter located on the edge of the mesh, it becomes difficult to emit electrons, which is a clear disadvantage. In order to overcome these disadvantages described above, and at the same time suppressing prolonged electrical discharge, the present applicants have already disclosed (Japanese Patent Application No. 133959/1996) a field emission type cold cathode device which is characterized by having insulating layers surrounding areas right under each emitter, as shown in FIG. 6, wherein the said insulating layers are formed with an insulator by filling up trenches which are set in a semiconductor substrate and surround respective areas right under each emitter.

In such a device, because the area right under each emitter is surrounded by the said insulating layer, respectively, carriers cannot spread over the surface of the semiconductor substrate or lower the resistance, and, as a result, even if the electric discharge takes place, the value of the resistance of the semiconductor substrate can be kept almost constant and thereby, the peak current of electric discharge can be controlled.

Further, this resistance is divided into respective insulating layers surrounding an area right under each emitter so that a voltage drop taking place to this resistance in normal operation is very small (1/the number of the division), compared with the aforementioned resistive layer. Further, no need to keep horizontal distances like in the resistive layer allows increasing the density of elementary emitters.

However, in a field emission type cold cathode device, as shown in FIG. 6, since the substrate is divided into respective areas right under each emitter surrounded by an insulating layer (Block group), the voltage drop in the said surrounded area is certainly small, but, in the normal operation, when electrons are sent forth from an emitter, each being separated from the others by a respective insulating layer surrounding the area right under this emitter, a depletion region is formed along the wall of the insulating layer, as shown in FIG. 7, resulting in an increase in resistance of the said surrounded and divided area.

This depletion region is generated, via the wall of the insulating layer, by a difference of the electric potential from that of the adjacent substrate area where no emitter is formed. That is, when electrons are sent forth from an emitter, a resistance of the said surrounded and divided area in the outer-most area below a formed emitter which causes a voltage drop to take place so that the electric potential right under the emitter goes up, which causes a difference of electric potential from that of the adjacent substrate where no emitter is formed, via the wall of the insulating layer, and thereby a depletion region is formed. As the emission increases, this phenomenon becomes more apparent and the emission current may saturate, as shown in FIG. 8.

As a result, in the emitter formed area group, each of which is surrounded by respective insulating layers, non-uniformity of the emission currents arises between the inner divided area sharing a surrounded insulating layer with an insulating layer surrounding another emitter group and the outer-most divided area not sharing an insulating layer with an insulating layer surrounding another emitter group. Therefore, such cold cathodes have disadvantages that, when applied to the flat screen display device, they may cause non-uniformity of brightness of the screen within the display area, and make the image quality very poor.

Further, according to an application by the present applicants (Japanese Patent Application No. 80840/1997), in order to solve the problem of the non-uniformity of emission resulting from the afore-mentioned difference between depletion region, methods to increase the width of insulating layers surrounding the outer-most divided areas, or alternatively to enlarge the size of the outer-most divided areas are disclosed, but this method has another disadvantage that, during the etch-back step which is normally carried out after burying the trenches in manufacturing a field emission type cold cathode, etching tends to proceed from sections near to the intersections of buried trenches and, as a consequence, the block corner sections are depressed in comparison with the central section of the block and the level of the emitter apex in the block corner sections is also lowered, which makes emission from the said sections difficult.

SUMMARY OF THE INVENTION

In light of the above problems, an object of the present invention is to provide a field emission type cold cathode, whereof a substrate is divided into respective areas right under an emitter surrounded by an insulating layer (emitter formed area group), wherein non-uniformity of the emission currents between the inner divided areas and the outer-most divided areas does not arise, and besides depressions in the block corner sections are well suppressed. An electron tube is equipped with the said cold cathode.

The above objects are attained by the present invention as described below.

Namely, the present invention discloses a field emission type cold cathode comprising a plurality of blocks arranged in array, wherein:

- an insulating layer and a conductive gate electrode layer are formed in succession on a silicon substrate, and
- open cavities are perforated through the said insulating layer and the said gate electrode layer to the surface of the silicon substrate, and
- in each of cavities, a cone-shaped emitter with a sharply pointed apex is formed, and
- the emitter formed area is divided into blocks by surrounding trenches which are filled up with the prescribed insulating material, in such a manner that each of the blocks includes at least one field-emitting micropoint cold cathode, whereby each block is completely separated from the other blocks with its own independent trench surrounding the said block.

Further, the present invention discloses an electron tube wherein the cold cathodes are the field emission type cold cathodes of the present invention.

Further, the said field emission type cold cathode is characterized in that a width of the trenches is equal to or more than 1.0 $\mu$m, or that the shape of the said block is a rectangle, a regular triangle or a regular hexagon, or that the insulating material to fill up the said trenches contains silica glass into which boron and phosphorus are mixed or polysilicon.

The present invention provides a cold cathode with such a structure that the block group is formed enclosing the silicon substrate in trenches which are filled up with the insulating material to surround a plurality of emitters within the substrate, as shown in FIG. 1, whereby each block is completely separated from the other blocks with an independent own trench surrounding each block.

According to the above means, the extension of the depletion region formed by the trench in each block can be made equal and the non-uniformity over the emission currents between blocks does not arise. Further, since no trench intersections exist, depressions in the block corner sections can be well suppressed in a step of etching back.

Figure 1A:
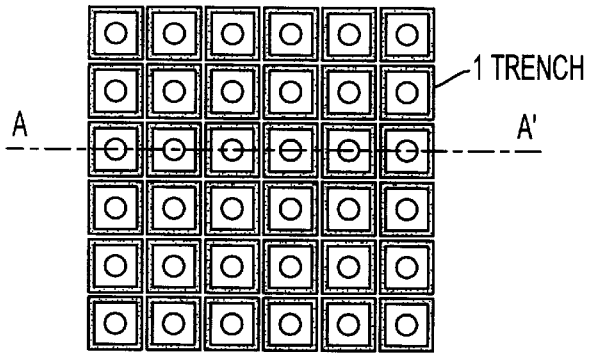
FIG. 1(*a*) is a schematic plan view of a field emission type cold cathode in accordance with a first embodiment of the present invention and FIG. 1(*b*) is a schematic cross-sectional view of FIG. 1(*a*), taken along the line A–A'.

Explanation of symbols:

1, 25, 105 . . . Trench
2, 21, 101 . . . Silicon substrate
3, 29, 102 . . . Emitter
4, 104 . . . Insulating layer
5, 27, 103 . . . Gate electrode
6, 26 . . . BPSG film
22 . . . $SiO_2$ film
23 . . . $Si_3N_4$ film
24 . . . PR (Photoresist)
28 . . . Sacrifice layer
106 . . . Depletion layer

DETAILED DESCRIPTION OF THE INVENTION

To illustrate the present invention, the following embodiments are described.

Embodiments

Referring now to the drawings, the present invention (field emission type cold cathode) is described in detail.

First Embodiment

Figure 1B:
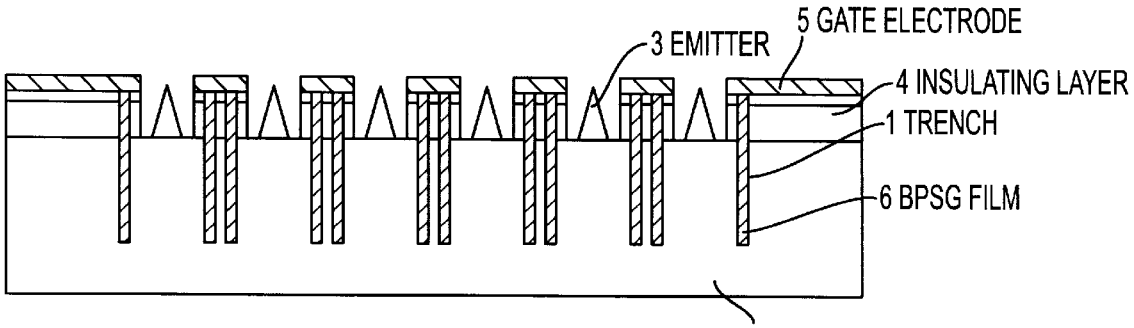
Figure 2A:
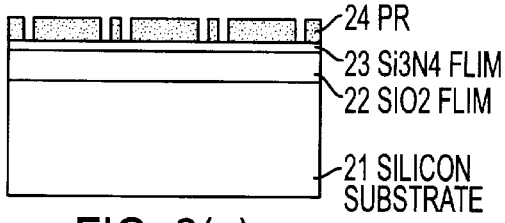
FIG. 2 is a schematic diagram illustrating the manufacturing steps of the first embodiment of the present invention.
Figure 2B:
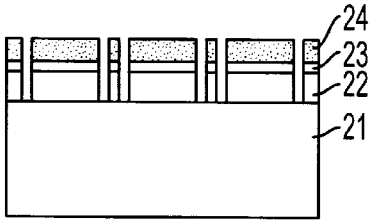
Figure 2C:
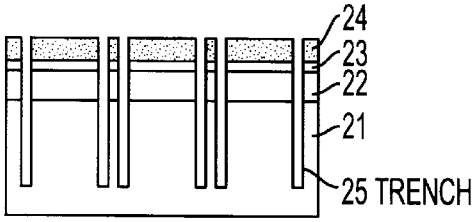
Figure 2D:
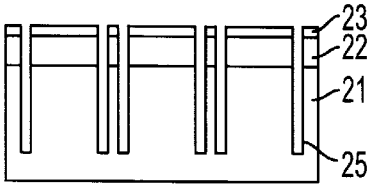
Figure 2E:
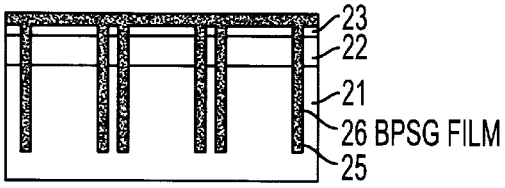
Figure 2F:
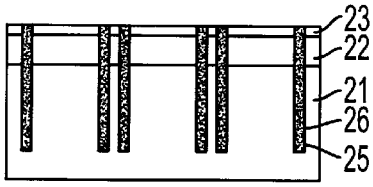
Figure 2G:
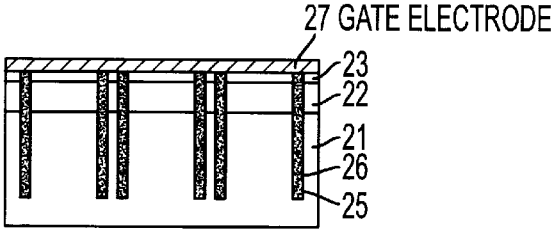
Figure 2H:
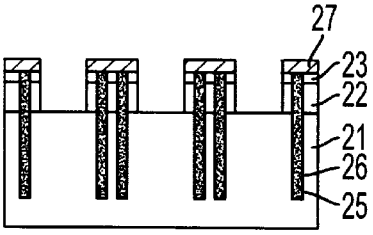
Figure 2I:
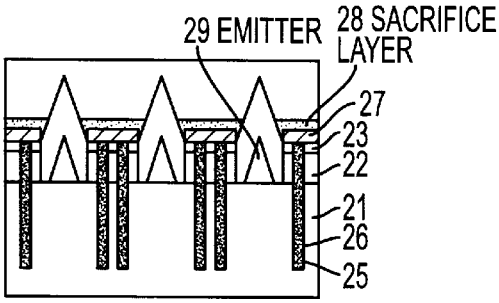
Figure 2J:
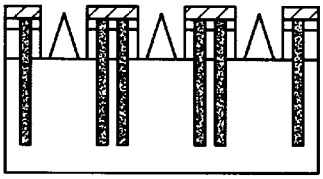

FIG. 1 is a schematic diagram showing the constitution of a field emission type cold cathode in accordance with a first embodiment of the present invention. FIG. 1(A) is a schematic plan view showing a field emission type cold cathode and FIG. 1(B) is a schematic enlarged sectional view of FIG. 1(A) taken along the line A–A'.

A field emission type cold cathode according to the present embodiment comprises a silicon substrate 2, emitters 3, an insulating layer 4, a gate electrode 5 and trenches 1 in which BPSG (borophosphosilicate glass:silica glass wherein into boron and phosphorus are mixed) film 6 is buried. In the present embodiment, an example comprising 36 blocks of rectangle divided by the trenches 1 is shown. Each block divided by the trenches 1 has a separate structure with an independent trench surrounding the block.

In the case that one trench is shared by adjacent blocks, the influence of the trench resistance in the normal operation of a field emission type cold cathode is first described. The silicon substrate surrounded by the trenches which serve as current paths, has a resistance whose value is determined by the substrate concentration, the size of the block surrounded by the trench and the depth of the trench so that a voltage drop takes place as each emitter releases electrons.

That is, by electron emission, the electric potential right under the emitter becomes higher than that of the substrate. Between blocks which face each other over an inserted trench and include no outer-most sections, the distributions of electric potentials are similar with respect to the trench, but on the other hand, if a block includes an outer-most section of the emitter formed area, a gap of electric potentials arises via a trench, due to asymmetry resulting from the fact that an outer-most section has no adjacent block on the outer side.

The electric potential of the silicon substrate right under an emitter becomes higher than that of its surroundings, which leads to the formation of a depletion region from the side wall of the trench towards right down the emitter. This substantially reduces the occupation area of block so that the value of resistance increases. The larger the amount of the emission is, the more marked this phenomenon becomes, and therefore, the emission current having a path inside of the block gradually becomes more difficult to pass through and eventually reaches to the saturation level, which differs largely from the said emission current having a path inside of the blocks which face each other over an inserted trench and include no outer-most sections.

In a field emission type cold cathode of the present embodiment, each block divided by a trench has a separate structure with an independent trench surrounding the said block, and the depletion region in each block has the equal extension. Such a design makes emission currents in all blocks within the emitter area uniform and can provide a field emission type cold cathode with high quality.

Next, referring to the drawings, an example of manufacturing methods of a field emission type cold cathodes having such a constitution is described.

First, as shown in FIG. 2(*a*), a $SiO_2$ film 22 with a thickness of approximately 5000 angstrom and then a $Si_3N_4$ film 23 with a thickness of approximately 1500 angstrom are successively deposited on a silicon substrate 21, and further the $Si_3N_4$ film 23 is coated with a photoresist 24 (abbreviated PR hereinafter) by photolithography, except areas over the positions where trenches are to be formed in the silicon substrate 21.

Next, as shown in FIG. 2(*b*), after performing patterning to form trenches in the silicon substrate 21 by using PR 24 as a mask, the $SiO_2$ film 22 and the $Si_3N_4$ film 23 are removed by reactive ion etching (abbreviated RIE hereinafter).

Next, as shown in FIG. 2(*c*), trenches 25 are formed by digging down portions of the silicon substrate 21 right under the sections where the $SiO_2$ film 22 and the $Si_3N_4$ film 23 are removed, up to the prescribed depth, by means of the RIE through a mask of PR 24.

Next, as shown in FIG. 2(*d*), after peeling off PR 24, the interior of the trenches 25 in the silicon substrate is subjected to thin oxidation.

Next, as shown in FIG. 2(*e*), a BPSG film 26 is grown to a thickness by chemical vapour deposition (abbreviated CVD hereinafter) as an insulating film, so as to fill up the trenches 25 in the silicon substrate 21 with the BPSG film 26, which is then reflowed with heat treatment to flatten the surface thereof. Although BPSG is used in this example, polysilicon or the like may be used instead.

Next, as shown in FIG. 2(*f*), the entire surface is subjected to the RIE to etch back the BPSG film 26, and the $Si_3N_4$ film 23 is exposed.

Next, as shown in FIG. 2(*g*), gate material is deposited on the $Si_3N_4$ film 23, by means of sputtering, vapour deposition or the like, to form a gate electrode 27. As gate material, W, Mo and $WSi_2$ may be used.

Next, as shown in FIG. 2(*h*), making use of photolithography, the gate electrode 27, the $Si_3N_4$ film 23 and the $SiO_2$ film 22 are partially etched, till the silicon substrate 21 is exposed by the RIE, thus setting a plurality of miniature openings.

Next, as shown in FIG. 2(*i*), a sacrifice layer 28 is formed with MgO, Al and such, by the method of oblique rotational deposition, followed by deposition of emitter material of high melting point metal such as W and Mo at normal incidence to the substrate, and thereby a plurality of cone-shaped emitters 29 are formed.

Finally, by etching the sacrifice layer 28, superfluous emitter material formed on the gate electrode 27 is lifted off. In this way, a field emission type cold cathode, having a structure shown in FIG. 2(*j*) can be obtained.

Further, in a step of etching back of FIG. 2(*f*), it is a common practice to perform the etching for more than a sufficient time (overetching), taking precautions against possible non-uniformity of etching within a pattern.

At the time of this step, because of a fast etching speed, in the trench intersections where large area of the BPSG film 26 is subjected to the etching, compared with other parts without trench intersections, unnecessary etching to the block corner sections may be performed during the overetching and may cause depressions.

However, according to the present invention, with no trench intersections being in structure, such an inconvenience as having depressions as in the conventional block corner sections can be suppressed.

Further, across the width of the trench, it is necessary to have a higher withstanding pressure than the electric potential difference generated between adjacent blocks in electric discharge. According to the examination performed by the present applicants, when trenches are filled up with BPSG, a withstanding pressure of being equal to or more than 100 V is attained for the trench with a width of being equal to or more than 1 $\mu$m.

Further, while in this description of the present embodiment one emitter is formed in each block, it is to be understood that a plurality of emitters in array may be set in each block.

Second Embodiment

Figure 3:
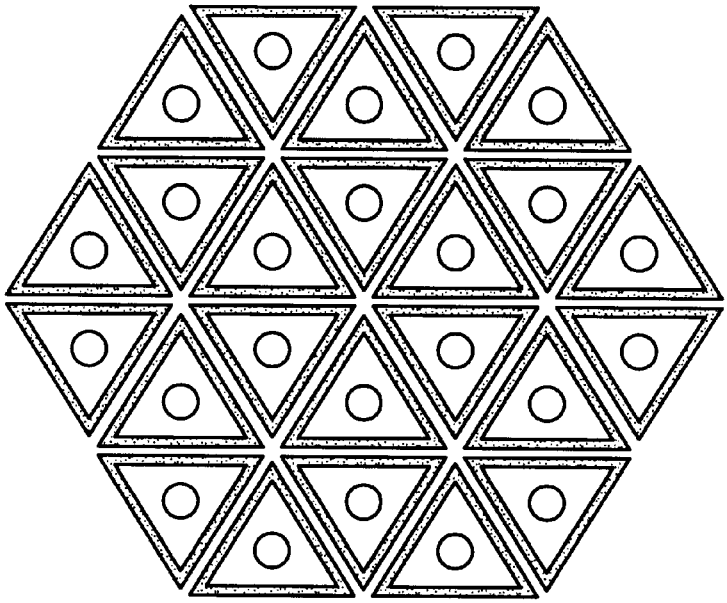
FIG. 3 is a schematic plan view of a field emission type cold cathode in accordance with a second embodiment of the present invention.

FIG. 3 is a schematic plan view illustrating the constitution of a field emission type cold cathode in accordance with a second embodiment of the present invention. A field emission type cold cathode of the present embodiment comprises blocks of regular triangles, instead of blocks of rectangle divided by the trenches 1 in the first embodiment. Each block has an independent trench surrounding the said block, respectively, as in the first embodiment.

In the present embodiment, the depletion region in each block divided by the trench has the equal extension, as in the first embodiment, and it is obvious that emission currents in all blocks within the emitter formed area are made uniform and that an inconvenience to have depressions in the block corner sections which may be produced during a step of etching back is well suppressed.

Further, while it is effective, in a device comprising rectangle cells, to divide into rectangular blocks by trenches 1, as shown in FIG. 1, when applied to the electron source for the Braun tube and the like, and besides it is required to arrange blocks of the constant area in an almost circular emission area, arrangement of rectangular block array lowers the disposition density of emitters 3, in comparison with arrangement of array of regular triangles.

Third Embodiment

Figure 4:
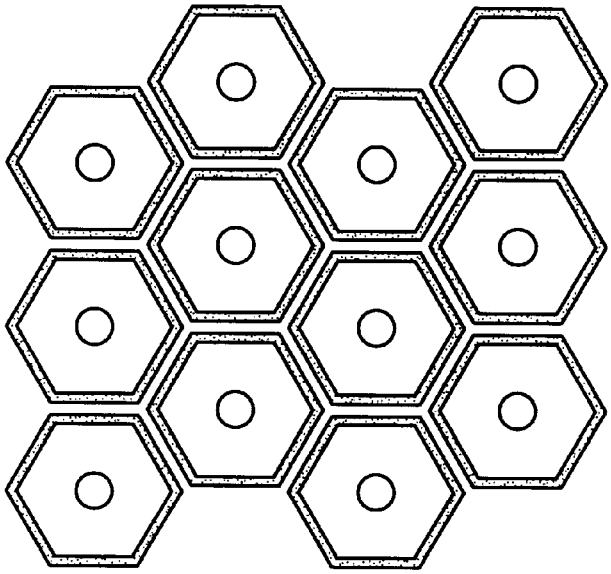
FIG. 4 is a schematic plan view of a field emission type cold cathode in accordance with a third embodiment of the present invention.
Figure 5:
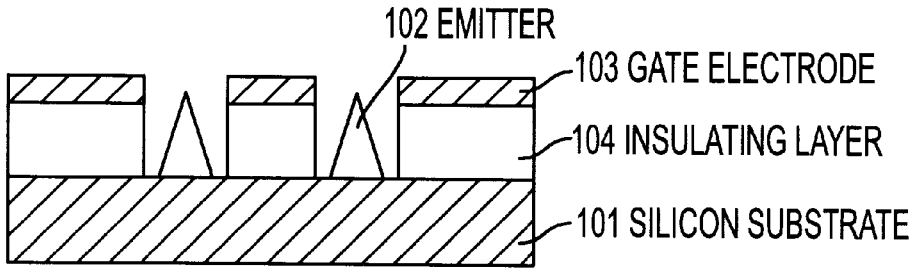
FIG. 5 is a schematic cross-sectional view showing the main part of the conventional Spindt-type cold cathode element.
Figure 6:
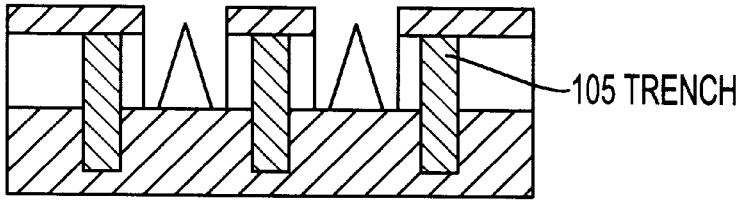
FIG. 6 PRIOR ART
FIG. 6 is a schematic cross-sectional view of a field emission type cold cathode disclosed in a co-pending application (Japanese Patent Application No. 133959/1996) and filed by the present applicants.
Figure 7:
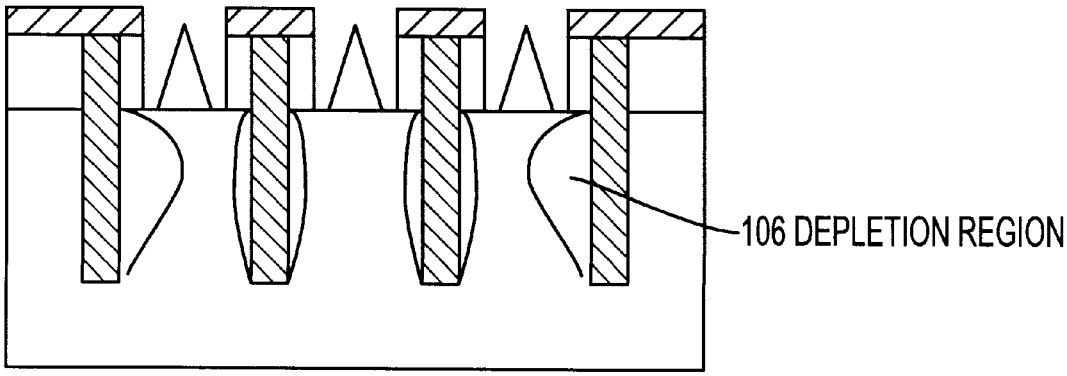
FIG. 7 is a schematic diagram illustrating formation of depletion layers of a field emission type cold cathode.
Figure 8:
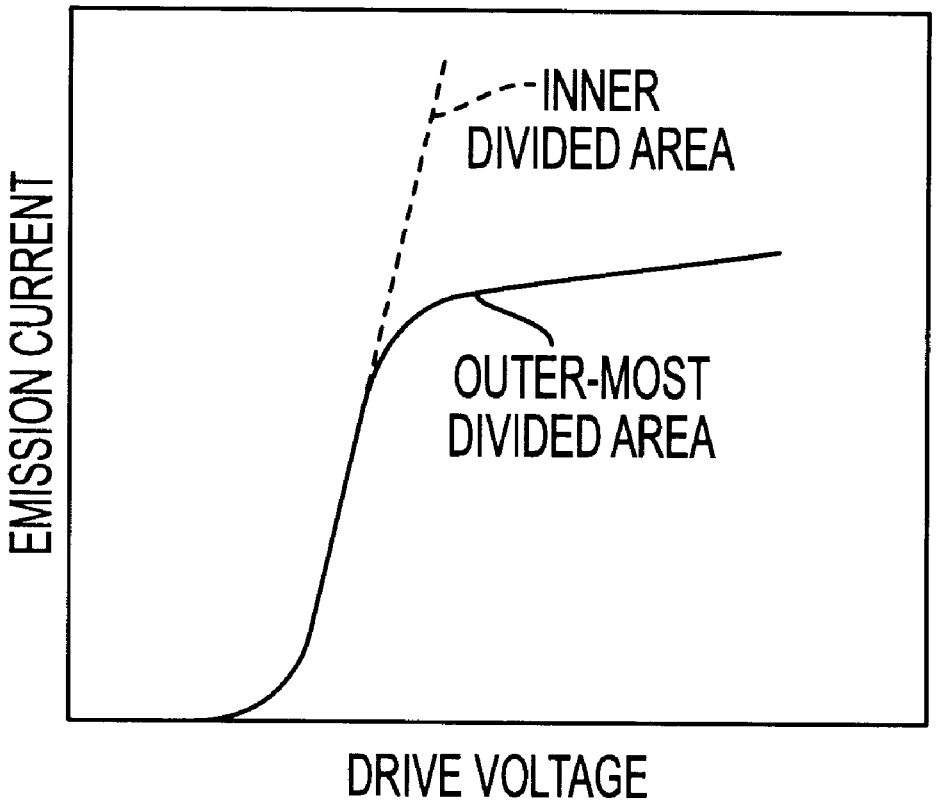
FIG. 8 is a graph showing the current-voltage characteristics of the field emission type cold cathode of FIG. 7.

FIG. 4 is a schematic plan view illustrating the constitution of a field emission type cold cathode in accordance with a third embodiment of the present invention. A field emission type cold cathode of the present embodiment is divided into blocks of regular hexagon, instead of blocks of rectangle divided by the trenches 1 in the first embodiment. Each block is divided with an independent trench surrounding the said block, respectively, as in the first embodiment.

In the present embodiment, the depletion region in each block divided by the trench has the equal extension, as in the first embodiment, and it is obvious that emission currents in all blocks within the emitter formed area are made uniform and that an inconvenience to have depressions in the block corner sections which may be produced during a step of etching back is well suppressed.

Further, as in the second embodiment, in the case that blocks of the constant area are arranged in an almost circular emission area, a field emission type cold cathode of FIG. 4 can reduce lowering the disposition density of emitters 3, in comparison with arrangement of rectangular block array.

Effects of the Invention

As described above, by employing the specific structure in accordance with the present invention, emission currents in all blocks within the emitter formed area at the time of normal operation can be made uniform, and moreover a good form wherein depressions in the block corner sections are well suppressed can be attained, and hence, when applied to the electron source for flat screen type display devices, it is possible to secure uniform brightness of the screen over the entire display area, and hereby a field emission type cold cathode with high quality as well as an electron tube equipped with the said cold cathode can be obtained.

What is claimed is:

1. A field emission type cold cathode with an emitter area comprising a plurality of blocks arranged in an array, said array of blocks comprising:

an insulating layer on a silicon substrate and a conductive gate electrode layer on said insulating layer;

open cavities through the insulating layer and the gate electrode layer to the silicon substrate; and in each of the cavities, a cone-shaped emitter with a sharply pointed apex, each cavity comprising a portion of a block, each block further including its own independent surrounding trench filled with a prescribed insulating material;

wherein each block is completely separated from the other blocks.

2. A field emission type cold cathode according to claim 1, wherein a width of the trench is equal to or more than 1.0 $\mu$m.

3. A field emission type cold cathode with an emitter area comprising a plurality of blocks arranged in an array, said array of blocks comprising:

an insulating layer on a silicon substrate and a conductive gate electrode layer on said insulating layer;

open cavities through the insulating layer and the gate electrode layer to the silicon substrate; and in each of the cavities, a cone-shaped emitter with a sharply pointed apex, each cavity comprising a portion of a block, each block further including its own independent surrounding trench filled with a prescribed insulating material;

wherein each block is completely separated from the other blocks, and wherein the shape of each of the blocks is a rectangle, a regular rectangle, or a regular hexagon.

4. A field emission type cold cathode with an emitter area comprising a plurality of blocks arranged in an array, said array of blocks comprising:

an insulating layer on a silicon substrate and a conductive gate electrode layer on said insulating layer;

open cavities through the insulating layer and the gate electrode layer to the silicon substrate; and in each of the cavities, a cone-shaped emitter with a sharply pointed apex, each cavity comprising a portion of a block, each block further including its own independent surrounding trench filled with a prescribed insulating material;

wherein each block is completely separated from the other blocks, and wherein the insulating material used to fill up the trenches contains silica glass into which boron and phosphorus are mixed.

5. A field emission type cold cathode according to claim 1, wherein the insulating material used to fill up the trenches contains polysilicon.

6. An electron tube having cold cathodes as the source of electron emission, wherein the cold cathodes comprise a field emission type cold cathode according to any one of claims 1–5.

* * * * *